United States Patent [19]

Payson et al.

[11] Patent Number: 5,014,682

[45] Date of Patent: May 14, 1991

[54] PELLET STOVE MANTEL WITH INTEGRAL HOPPER

[76] Inventors: Steven J. Payson; John C. Lee, both of 3301 W. Hwy. 16, Ste. #1, Port Orchard, Wash. 98366

[21] Appl. No.: 522,584

[22] Filed: May 14, 1990

[51] Int. Cl.[5] ..... F24B 1/99

[52] U.S. Cl. ..... 126/501; 126/68; 126/73; 126/10

[58] Field of Search ..... 126/501, 73, 68, 7, 126/10

[56] References Cited

U.S. PATENT DOCUMENTS

| | | | |
|---|---|---|---|
| 124,325 | 3/1872 | Brown | 126/501 |
| 127,500 | 6/1872 | Merrill | 126/501 |
| 810,719 | 1/1906 | Cleaver . | |
| 1,391,394 | 9/1921 | Loyer . | |
| 1,688,430 | 10/1928 | Owens | 126/501 |
| 3,888,231 | 6/1975 | Galluzzo et al. | 126/120 |

*Primary Examiner*—Larry Jones
*Attorney, Agent, or Firm*—Foley & Lardner

[57] ABSTRACT

A mantel device for storing and dispensing fuel for insert-type pellet stoves having a continuous feed hopper. A pellet stove mantel has a hopper inside the mantel. The mantel hopper is attachable to the continuous feed hopper of the pallet stove and provides hopper to hopper fuel feed. The mantel device has the appearance of a zero clearance fireplace including a flush mounted mantel, a pedestal lift attached to the main frame of the mantel and a hearth mat is fastened to the main frame of the mantel and the pedestal lift. The mantel hopper is located in the upper portion of the mantel and has a plurality of angled sides forming a funnel. The mantel also has a cap at the top with an opening covered by a lid which provides an access to the hopper.

7 Claims, 2 Drawing Sheets

PELLET STOVE MANTEL WITH INTEGRAL HOPPER

BACKGROUND OF THE INVENTION

1. Field of the Invention

The present invention relates to a mantel which can be utilized in connection with a pellet stove, more particularly to a mantel having a hopper which combines with the hopper of a pellet stove to create a hopper to hopper fuel feed.

2. Brief Description of Related Art

It has been common practice to provide insert pellet stoves for fireplaces. However, it has been necessary to load pellets into the stove hopper every day or two.

There have been numerous devices which generally provide means for feeding fuel from a hopper into the fire. One of these is illustrated in U.S. Pat. No. 810,719 which discloses a fireplace adapted to either fit a domestic hearth or receive an open grate or stove. The fuel hopper is located at the top of the fireplace, and burning fuel descends by gravity through the chute. Fuel may also be added through an external door.

Another patent, U.S. Pat. No. 1,391,394 discloses a method of introducing fuel into a fireplace heating system by means of a chute from an internal fuel box.

Finally, U.S. Pat. No. 3,888,231 discloses a telescoping fuel hopper and chute for introduction of fuel into the firebox of an open hearth type fireplace.

The designs discussed above share the disadvantage that the fuel must be continuously added to the fireplace. Furthermore, these designs do not incorporate a modern insert pellet stove.

OBJECTS AND SUMMARY OF THE PRESENT INVENTION

An object of the invention is to provide a mantel with an integral hopper which extends the time between loading of fuel from once every one to two days to once every seven to ten days.

It is an object of the present invention to provide increased fuel storage for insert stoves.

It is also an object of the present invention to provide a continuous feed of stored fuel.

It is a further object to provide an insert pellet stove with a mantel and add-on hopper which converts the stove's appearance to that of a zero clearance fireplace.

The present invention relates to a mantel device for storing and dispensing fuel for insert pellet stoves having a continuous feed hopper. The mantel has a built-in hopper which is attachable to the continuous feed hopper of the pellet stove and provides hopper to hopper continuous fuel feed. The mantel of the present invention surrounds the insert stove and changes the stove's appearance to that of a zero clearance fireplace. The mantel hopper is located in an upper portion of the mantel and is accessible through an access door in the top of the mantel.

BRIEF DESCRIPTION OF THE DRAWINGS

The objects and advantages discussed above and other features of the present invention will be more fully understood when considered in conjunction with the accompanying drawings, wherein.

DETAILED DESCRIPTION OF THE PREFERRED EMBODIMENTS

Figure 1:
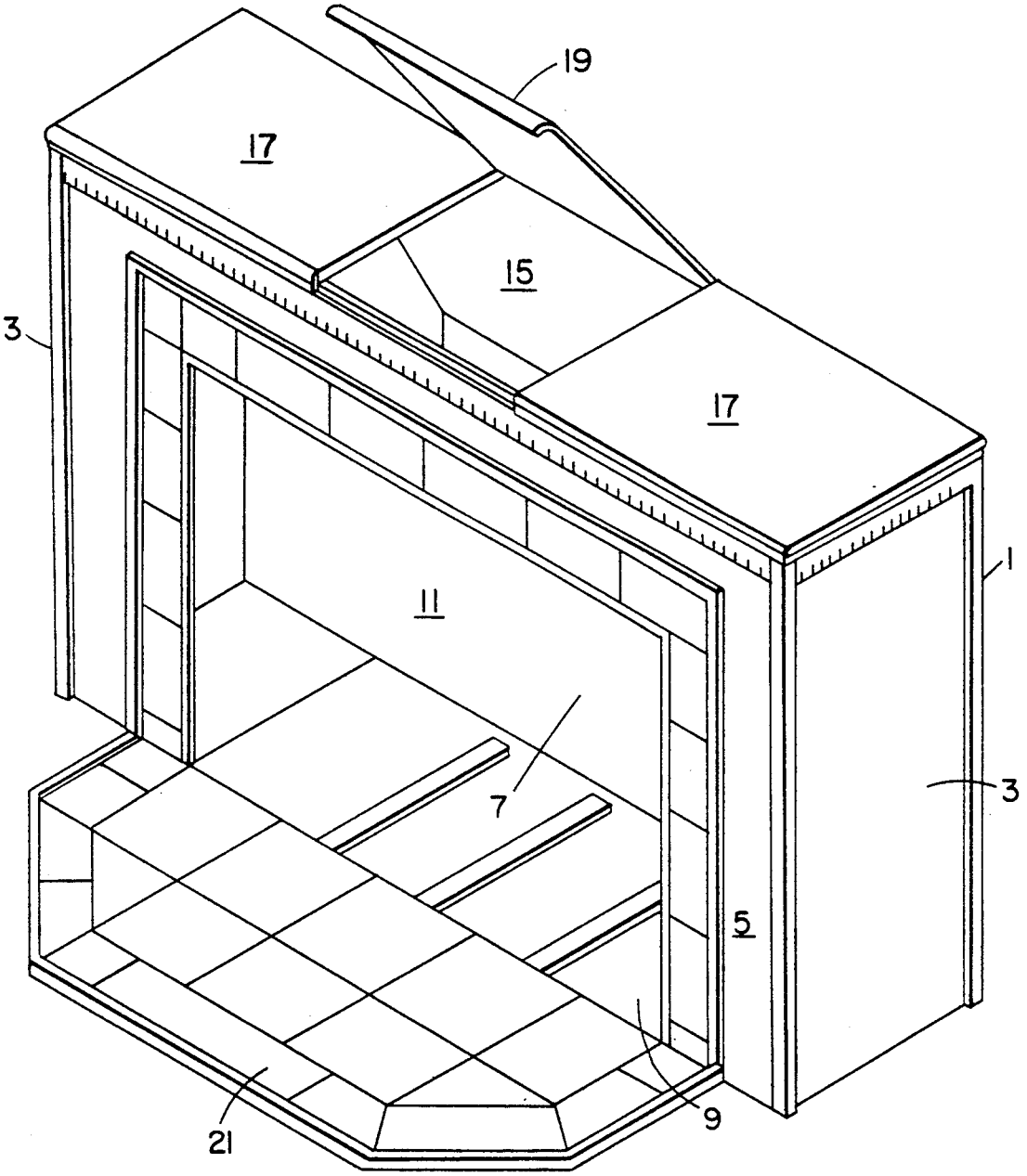
FIG. 1 is a perspective view of the mantel of the present invention.

As shown in FIG. 1, a mantel 1 has an essentially rectangular shape and is formed by a pair of sides 3, as well as a front 5 and a back 7 extending between the sides. The mantel 1 also includes a bottom floor 9 which joins the sides 3, the front 5 and the back 7, and rests on the floor. The front 5 has an insert opening 11 for placement of an insert type pellet stove 13 in FIG. 3. The insert opening 11 is located at the center of the front 5 and extends from the bottom of the front 5 to a height approximately equal to the height of an insert stove with an extra inch for clearance. The insert opening 11 is also essentially rectangular. The front 5 may optionally include detailing such as molding, trim or a tile border surrounding the insert opening. The mantel 1 is constructed of particle board and oak veneer or any other suitable material. The mantel 1 is divided into an upper portion in which a hopper 15 is located and a lower portion in which the insert stove 13 is placed. The lower portion extends from the bottom 9 which rests on the building floor to the top of the insert opening 11. The upper portion extends from the insert opening 11 to the top of mantel 1.

The upper portion of the mantel is closed off by a cap 17 which fits over the sides 3, the front 5 and the back 7. The cap 17, which is constructed of veneer or similar material, may also include molding or trim along its edges. The cap 17 is not a single continuous piece since a lid or access door 19 is positioned in the center of the cap 17. This lid 19 is hinged along the rear edge so that it may be lifted up like a door and provide access to the hopper.

A hearth pad or mat 21 extends along the floor and joins the bottom floor 9 at the insert opening 11 and along the bottom edge of the front 5 on either side of the opening 11. The hearth pad 21 has a sufficient thickness so that it is raised off the floor. The pad 21 may have a height of several inches off the floor giving it a raised appearance. The height of the pad 21 is varied to alter the appearance of mantel 1. The pad 21 may also vary in shape and should be constructed of an appropriate heat resistent hearth material. The pad 21 may also be designed with tiling that matches the tiling boarder along the front 5.

The mantel 1, as may be seen from FIG. 1, is constructed so that it has the appearance of the zero clearance fireplace.

Figure 2:
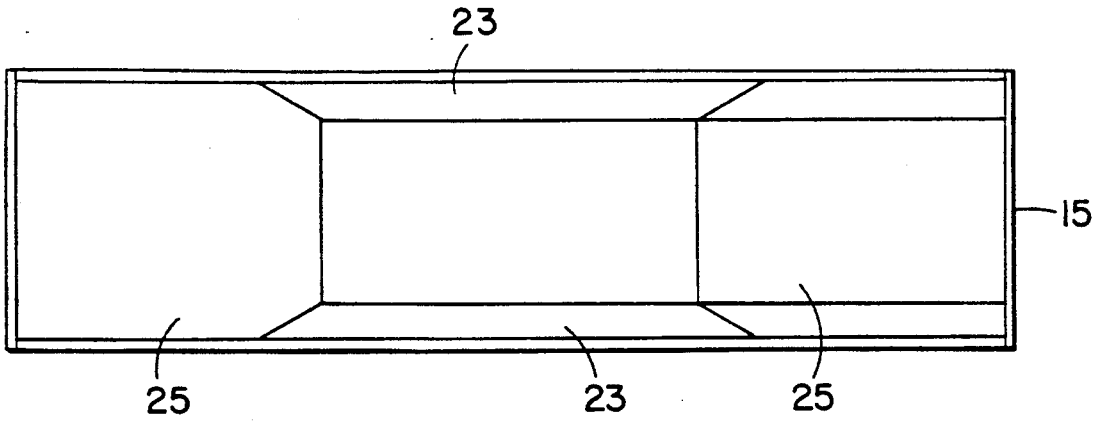
FIG. 2 is a plan view of the hopper.

The hopper 15 which is concealed in the upper portion of mantel 1 has a plurality of angled sides 23 and 25 as shown in FIG. 2. The sides are angled so that the hopper 15 has a funnel shape to aid in fuel feed. The pellet stove 13, when inserted into the mantel 1, is positioned so that its integral hopper is aligned with and cooperating with the mantel hopper 15. The hopper to hopper connection provides continuous feed from the extra storage provided in the mantel hopper 15. The mantel hopper 15 extends across the entire hopper from side to side and front to back. The hopper 15 is designed to add additional fuel storage capability to the pellet stove so that approximately one week or more of worry-free burn time is provided. During this time, no additional fuel need be added to the hopper 15. The hopper 15 may be filled by lifting the lid 19 shown in FIG. 1 and pouring the fuel into the hopper. The hopper 15 transforms the upper portion of the mantel into a fuel storage device.

Figure 3:
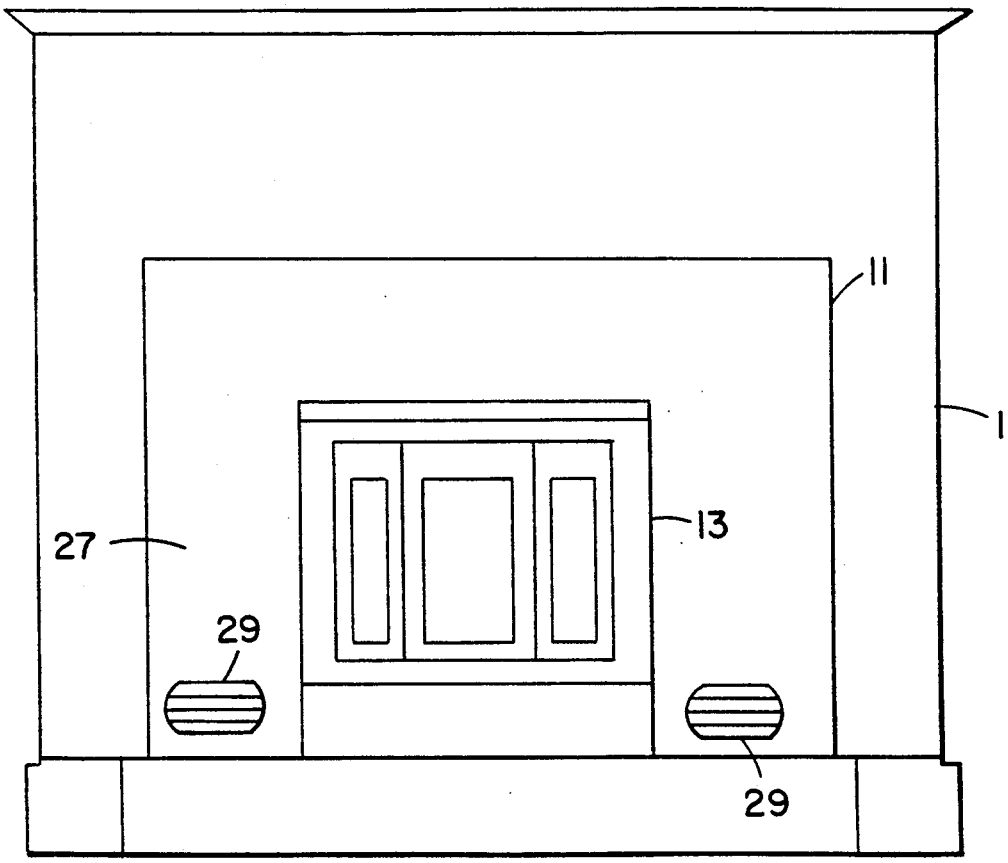
FIG. 3 is a front elevational view of the mantel and an insert stove.

FIG. 3 shows an elevational view of the mantel 1 with an insert stove 13 installed in the insert opening 11. A screen 27 is provided to form a wall behind the stove and seal off the insert opening 11. The screen includes air intake and outlet vents 29 positioned on the screen near the hearth pad. The insert pellet stove has an integral continuous feed hopper. The insert stove is positioned within the insert opening 11 so that the mantel hopper 15 and the stove hopper cooperate with each other and provide increased continuous feed for the stove.

It will be appreciated that the above description and accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. A combination of a fuel storing and dispensing pellet stove mantel and an insert-type pellet stove, comprising:

(a) the pellet stove mantel having:

(1) an insert opening therein formed by a pair of sides and an upper portion, (2) a mantel hopper in the upper portion and forming substantially the entire upper portion, (3) a top opening in the upper portion for gaining access to and for filling the mantel hopper, (4) a closure over the top opening, (5) a bottom hopper opening above and adjacent to the insert opening; and (b) the insert-type pellet stove positioned in the insert opening and having a stove hopper immediately adjacent to the bottom hopper opening for receiving fuel stored in the mantel hopper thereinto.

2. A device according to claim 1, wherein the pellet stove mantel comprises:

a flush mounted mantel; and a hearth mat attached by fastening means along a bottom edge of the mantel.

3. A device according to claim 1, wherein the mantel is constructed from oak veneer.

4. A device according to claim 1, wherein the mantel hopper is located in an upper portion of the mantel and comprises a plurality of angled sides forming a funnel of the mantel hopper.

5. The device of claim 4, wherein the mantel has a cap at the top thereof, the cap having the top opening therein, and a lid closing the opening.

6. A method for storing and dispensing fuel for an insert-type pellet stove comprising:

(a) providing an insert-type pellet stove having a stove hopper thereon;

(b) providing a storage device comprising a pellet stove mantel having a mantel hopper and an insert opening therein;

(c) inserting the pellet stove in the insert opening in the mantel of the storage device;

(d) placing the mantel hopper immediately adjacent to the stove hopper;

(e) filling the mantel hopper with pellet stove fuel; and (f) permitting pellet stove fuel to move from the mantel hopper into the stove hopper.

7. The method of claim 6 including permitting the pellet stove fuel to continuously move from the mantel hopper to the stove hopper.

* * * * *